United States Patent [19]

Colonello

[11] Patent Number: 4,752,067

[45] Date of Patent: Jun. 21, 1988

[54] APPARATUS FOR USE IN EXERCISING THE ABDOMINAL MUSCLES

[76] Inventor: Dennis J. Colonello, 100 Hillpark Lane, St. Catharines, Ontario, Canada, L2N 7C7

[21] Appl. No.: 884,085

[22] Filed: Jul. 10, 1986

[51] Int. Cl.[4] ..... A63B 23/02

[52] U.S. Cl. ..... 272/93; 272/144

[58] Field of Search ..... 272/93; 128/68, 69; 297/453, 458, 463, DIG. 2; 280/12 AB, 12 B, 18; 272/144, 55, 56

[56] References Cited

U.S. PATENT DOCUMENTS

| | | | |
|---|---|---|---|
| D. 152,394 | 1/1949 | Ceverha | 272/93 |
| 1,904,039 | 4/1933 | Bruder | 128/69 |
| 4,132,228 | 1/1979 | Green | 128/68 |
| 4,230,099 | 10/1980 | Richardson | 128/69 |

FOREIGN PATENT DOCUMENTS

| | | | |
|---|---|---|---|
| 2410473 | 8/1979 | France | 128/69 |

*Primary Examiner*—Richard J. Apley
*Assistant Examiner*—S. R. Crow
*Attorney, Agent, or Firm*—Donald E. Hewson

[57] ABSTRACT

Apparatus for use in exercising the abdominal muscles, which improves the physiological effectiveness of the familiar sit-up exercise, is disclosed. The apparatus is comprised of a specially shaped basin which cradles the pelvis while at the same time the lumber spine is supported by a longitudinal support portion. The angulation between the pelvic basin and the lumber support portion is arched convexly superiorly to accommodate the anatomical transition between the sacrum and the lumber spine. A rocker portion thereby properly activates the several abdominal muscle groups during use. The rocker portion also cradles the user's tailbone suspending the boney structure and thereby reducing frictional and compressional forces thereon. Two handles to suit several arm lengths are on opposing sides of the pelvic basin, and are designed to assist proper posturing of the user on the device and to allow for use of upper extremity strength in assisting the user to perform the exercise. Two inferior projections on opposing sides of the pelvic basin act as lateral stabilizers, and so as to prevent injury to the user's hands while grasping the handles.

13 Claims, 5 Drawing Sheets

SEC. 'A'-'A'

SEC. 'B'-'B'

SEC. 'C'-'C'

APPARATUS FOR USE IN EXERCISING THE ABDOMINAL MUSCLES

BACKGROUND OF THE INVENTION

This invention relates to an apparatus for use in exercising of the abdominal muscles.

A flat stomach is not only aesthetically pleasing but also indicates that an individual has the abdominal strength necessary to prevent some types of low back pain. A flat stomach is an objective of nearly all exercise programs. The sit-up, also known as the abdominal curl, is the most popular exercise one can do in effort to flatten the abdomen. Other exercises purporting to strengthen the abdominal muscles first rise in favour and then often fall into disuse because of their ineffectiveness or because they are difficult to perform.

A major problem facing designers of abdominal exercises is that the forward bending trunk movement necessary to strengthen the abdominal muscles (principally the rectus abdominis) can be done more powerfully by the psoas major and iliacus—two muscles that are under greater tension than the rectus. Although these two muscles are powerful hip and thigh flexors, they attach to the lumbar spine area and rear of the pelvis and to the hip bone. When they contract, not only does the rectus work with little effort, but these other two muscles rotate the pelvis forward; thus creating a situation that can increase low back pain, contribute to poor mechanical alignment, and produce an undesirable sway-backed, duck-footed posture. In the conventional sit-up, if the feet are locked under an object to obtain leverage, the strong leg muscles (quadriceps femoris) will also substitute for the abdominals.

SUMMARY OF THE INVENTION

It is the basic object of the present invention to provide improved apparatus for use in exercising the abdominal muscles, which apparatus may be used in the household as well as professionally. An important object of the invention is to improve the physiological effectiveness of the familiar sit-up exercise, as related to abdominal muscle strength and tonicity.

In the conventional sit-up exercise the subject lies supine, face-up, on the floor with the hips and knees flexed approximately 90 degrees and the hands located behind the head.

The present invention provides a specially shaped device upon which the subject lies to perform the exercise. In using this novel apparatus, the subject is positioned essentially as described for the conventional sit-up exercise with the exercising apparatus located between the subject and the floor. In accordance with the invention, provision is made for the pelvis to be cradled in a pelvic basin portion while the lumbar spine is supported by a longitudinal support portion in acceptable Lordosis (extension). The angulation of the area of interface between the two portions is arched convexly superiorly to support the anatomical transition between the sacrum and the lumbar spine.

Apparatus for use in exercising the abdominal muscles in accordance with the present invention includes a basin portion defining a longitudinal axis of symmetry for receiving the buttocks and supporting the pelvis. This portion is elliptical in shape with the perimeters smoothly sloping upwards except for the area of transition to the lumbar support portion. The sloping of this area is convexly arched superiorly to accommodate a support transition that ensures maintenance of an anatomically acceptable lumbo-sacral angle (the angle formed by the sacrum and the lumbar spine) in the recumbant posture. The lumbar spine supporting portion extends from the basin transition as mentioned above and is aligned with the axis of symmetry. This spine supporting portion is smoothly convexly curved or arched upwardly such that, in use, with the user's buttocks positioned in the basin portion and the lower back disposed on the lumbar spine supporting portion, the normal lordosis curvature of the lumbar spine is substantially maintained. As well, the lower portion of the spine support is angulated to meet the pelvic portion (the area of transition) in such a manner as to ensure maintainance of an anatomically acceptable lumbo-sacral angle that has been determined by numerous researchers and is well documented in literature.

As a further feature of the invention, a rocker portion extends below the basin portion, such rocker demanding the exercise apparatus to rock front to back as a whole about an axis transverse to the symmetry axis as the abdominal muscles are exercised.

The rocker mechanism is elliptical in cross-section, being deeper and more steeply sloped at the origin centrally, to become more shallow as it tails towards the perimeter of the pelvic portion. This factor ensures proper placement of the pivot point—a critical factor in the effectiveness of this invention. The centre of gravity of the human body lies on or about the second sacral tubercle, and the pivot point of the rocker mechanism is strategically placed below this body area, thereby ensuring smooth effortless forward and backward rocking.

The rocker portion is aligned with the symmetry axis and is also adapted to permit side to side rocking of the exercising apparatus, thereby to activate the oblique abdominal muscles during use.

On the inferior surface of both sides of the pelvic basin there are two inferior projections that serve to control the extent of lateral rocking, and also to prevent injury to the user's hands while grasping the pelvic basin handles in performing the exercise. These are termed lateral stabilizers.

The basin portion of the apparatus includes a pair of buttock receiving and supporting areas designed to accommodate the buttocks in both the supine recumbent and seated postures. They are located on opposite sides of the axis of symmetry, in a manner that gradually flares upwards and outwards in the configuration of a triangle resembling the triangular shape of the sacrum bone, and extending into the area of transition between the pelvic and lumbar portions. This triangular configuration effectively aligns the user's pelvis, lumbo-sacral transition and boney tailbone over the appropriate receiving area of the apparatus. The recess cradles the user's tailbone and suspends the boney structure, thereby effectively reducing the frictional and compression forces commonly encountered in the conventional sit-up exercise.

The rocker portion is preferably integrally formed in the basin portion as a contoured (concave on the superior surface and convex on the inferior surface) projection that is elliptical in shape, with placement of the pivot point backwards of the midpoint of the projection.

Preferably the above-noted basin portion, the lumbar spine supporting portion, and the transition between the two, comprise integral parts of a unitary body; with the transition area arching convexly superiorly to allow for acceptable support of the normal lumbo-sacral angulation in the recumbant posture.

The previously noted unitary body is typically formed from a relatively thin moulded shell of injection moulded plastics, exhibiting varying degrees of flexibility and rigidity at integral sites of the unitary body. The variances in flexibility are due to the physical properties of the injection moulded plastics in relation to the inherent design of the apparatus. The transition area between the pelvic portion and the lumbar spine support portion is more flexible than the adjacent portions, and the rocker mechanism and pelvic basin is more rigid than the adjacent portions. Of course, other plastics moulding or forming procedures may also be used.

The objectives of the invention are to:

maintain an anatomically acceptable lordosis of the lumbar spine.

maintain an anatomically acceptable lumbo-sacral angle in the recumbant position.

minimize compression forces on the spine during phases of initiation and completion of the exercise.

allow the spine to spring posteriorly into the flexible lumbar support portion of the apparatus.

offer an initial momentum to aid the lift of the upper torso into the exercise range of motion, by promoting pelvic tilt.

minimize localized segmental spinal stress.

distribute the compression forces of inertia over the entire length of the lumbar spine support portion.

protect the transitional segment L5-S1 (lumbo-sacral angle) from strain.

direct compressional forces on the lumbar discs in an anterior direction, away from the neural canal and spinal cord and nerves.

cause an arc of motion of the vertebral bodies to be directed backwards, allowing the facet joints to bear the forces of compression for which they are inherently designed.

cradle the pelvis as an unimodular segment, thereby reducing torsion between the pelvis and the spine.

cause pelvic rotation about the horizontal axis to occur at or about the S2 tubercle (the natural centre of gravity of the body).

reduce the incidence of muscle substitution by the iliopsoas and quadriceps muscles, thereby increasing the lift demand on the abdominal muscles proper.

obligate a central nervous system activation to control balancing on the apparatus by effective contraction of the entire abdominal girdle to include: Rectus Abdominus (bilaterally), Internal Obliques (bilaterally), and External Obliques (bilaterally).

demand effective work output of the entire abdominal girdle, as described above.

increase muscle lift demand in the effective midrange of motion.

minimize torsional strain to the spine and pelvis.

reduce frictional and compression forces to the tailbone.

provide for successful performance of the sit-up exercise utilizing partial assist from upper extremity strength.

BRIEF DESCRIPTION OF THE DRAWINGS

Further features of the invention will be apparent from the following description and the appended claims; and from a review of the drawings, in which:

DETAILED DESCRIPTION OF THE PREFERRED EMBODIMENT:

With reference now to the drawings, the exercising apparatus 10 is illustrated as comprising a unitary body formed from a relatively thin injection moulded shell of plastic, exhibiting varying degrees of flexibility and rigidity at integral sites of the unitary body. The variances in flexibility are due to the physical properties of the injection moulded plastic in relation to the inherent design of the apparatus. The transition area (shaded between lines B—B and C—C of FIG. 2) which is between the pelvic portion and the lumbar spine, supports the rocker mechanism and the pelvic basin, and is more rigid than the adjacent portions when the apparatus is injected moulded. If vacuum formed or otherwise produced, the apparatus can be ribbed or reinforced so as to have the same rigidity in the transition area.

The exercising device 10 essentially comprises a basin portion 12 which is elliptically shaped and sized to receive the user's buttocks and to support the pelvis, and a lumbar spine support portion 14 extending from the basin portion and aligned with the axis of symmetry. Interfacing the two portions between lines B—B and C—C (the shaded area in FIG. 2) is the transition area which is arched convexly superiorly to accommodate maintenance of the normal lumbo-sacral angle (defined as the anatomical transition between the sacrum bone of the pelvis and the L 5 vertebrae of the lumbar spine). [There is a general agreement that a normal lumbo-sacral angle is 35 degrees to 40 degrees, more or less.] This is a major safety feature of this device. The axis of symmetry is along the line A—A in FIG. 2.

Figure 5:
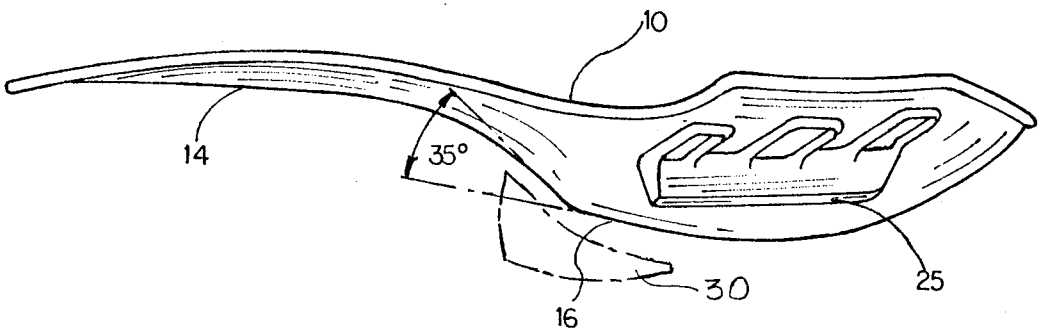
FIG. 5 is a side elevation view of FIG. 2.
Figure 6:
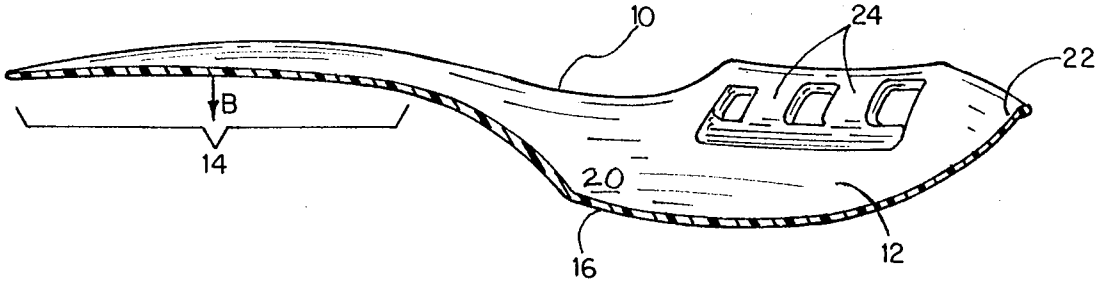
FIG. 6 is a section view taken along line A—A of FIG. 2.
Figure 7:
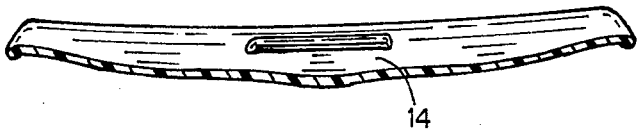
FIG. 7 is a section view taken along line B—B of FIG. 2.

The lumbar spine support portion 14 is best seen in FIG. 5 and FIG. 6 as smoothly convexly curved superiorly or arched upwardly such that, when the device is in use, with the user's buttocks positioned in the basin 12 and the lower back disposed on the lumbar support portion 14, a desired degree of lordosis in the lumbar spine and an anatomically acceptable lumbo-sacral angle is maintained while in the supine neutral position. What is meant by "anatomically acceptable" is that, as noted above, it is generally accepted by experts on the anatomy that a normal lumbosacral angle is in the order of 35 degrees to 40 degrees; the exact amount of inclination will vary usually more or less within that range, from person to person. For any individual, therefore, the lumbar spine support portion 14 will maintain that person's normal lumbo-sacral angle which is presumed to be within the range of 35 degrees to 40 degrees in a comfortable and well supported position while the user's body is in the supine neutral position. In other words, an anatomically acceptable lumbo-sacral angle is that angle in the normal range of lumbo-sacral angles which the user's spine assumes when the body is first correctly positioned on the exercising device 10 of the present invention.

When the sit-up exercise is commenced, the flexible transition area (shaded between lines B—B and C—C on FIG. 2) springs backwards towards the floor as the lumbar spine flattens, thus creating a natural pelvic tilt and preventing exaggeration of the lumbo-sacral angle or excessive lordosis which may be harmful to the lower spine. Pelvic tilt is a manoeuver familar to the exercise enthusiast and the low back pain sufferer alike, and consists of flexing of the pelvis to flatten the lower back thereby to reduce strain on the sensitive discal structures.

It will also be seen, especially from the side and cross section views of FIG. 5 and FIG. 6 that the lumbar spine support portion 14 is also shallowly concavely curved along the symmetry axis A—A. The concavity becomes less pronounced at the perimeters, whereby to "cradle" the user's lower back therein during use.

Figure 4:
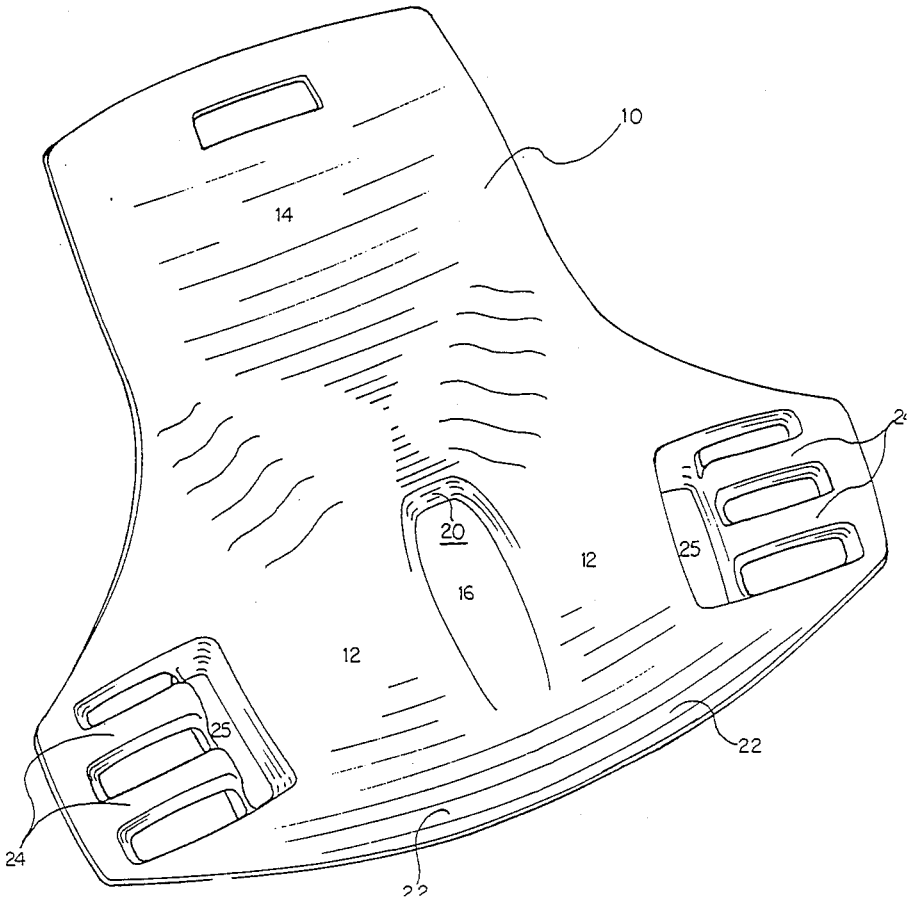
FIG. 4 is a perspective view thereof.
Figure 8:
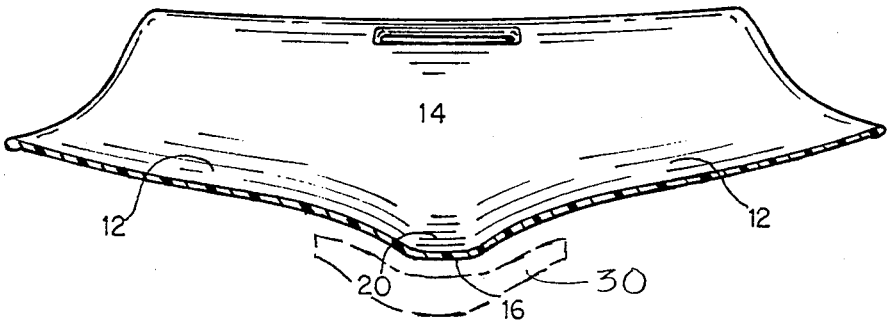
FIG. 8 is a section view taken along line C—C of FIG. 2.

A rocker portion 16 extends below the pelvic basin as a convex elliptical projection. This rocker portion has a deeper cavity as it tails towards the periphery of the pelvic basin. This convex elliptical projection permits the exercise apparatus 10 to rock front to back as a whole about an axis transverse to the symmetry axis as the abdominal muscles are exercised during the course of a series of sit-up exercises. As will be seen in FIG. 2, the rocker portion 16 is aligned with the symmetry axis A—A thereby to allow side to side rocking of the apparatus as a whole whereby to stimulate and activate the oblique abdominal muscles during use, as will be described in more detail hereafter. The ellipitcal shape of the rocker portion 16 is the factor that ensures proper placement of the pivot point of rocking motion, and is a critical factor in the effectiveness of this invention. The centre of gravity of the body lies on or about the second sacral tubercle, and the pivot point of the rocker portion is integrally formed in the basin portion 12 thereby to define a contoured projection. Accordingly, a recess 20 is defined in the superior (upwards facing) buttock receiving area of the basin portion 12 coinciding with the location of the rocker projection as best seen in FIG. 4 and FIG. 8. The recess 20 "cradles" the user's tailbone as the buttock receiving areas 22 suspend the boney tailbone over the recess, thereby effectively reducing frictional and compression forces commonly encountered in the conventional sit-up exercise.

Figure 10:
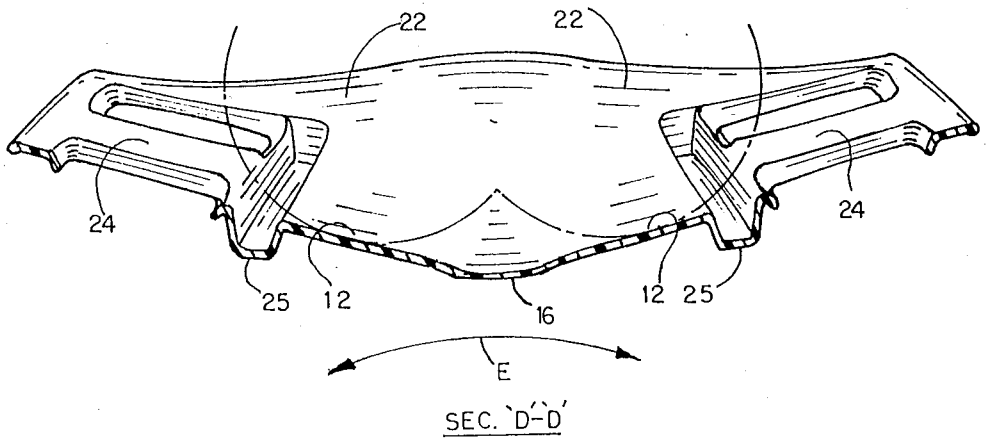
FIG. 10 is a section view taken along line D—D of FIG. 2.

The pelvic basin portion 12 includes a pair of shallowly concavely curved buttock receiving and supporting areas 22 on opposing sides of the axis of symmetry A—A as seen best in FIG. 6 and FIG. 10. The transition between the recess 20 and the buttock receiving areas 22 on either side of the recess comprises a triangularly shaped mild recess transition that gradually flares outwards and upwards in the configuration of a triangle resembling the shape of the sacrum bone and extending into the area of transition between the pelvic 12 and lumbar spine 14 portions. This triangular configuration effectively aligns the user's pelvis, lumbo-sacral angle, and tailbone over the appropriate receiving area of the apparatus. This subtle triangular shaped recess is best seen in FIG. 2 as the contour shadings on either side of the symmetry axis A—A and disected by line B—B, and on FIGS. 4 and 8.

On either side of the apparatus 10 in the lower half of the pelvic portion 12 there are a pair of projecting handle portions 24, as shown in FIGS. 2, 4, 5, 6 and 10. The user grips these handles for assistance during exercising, as well as to adjust and maintain position of the apparatus relative to the user's anatomy and thereby to obtain greater comfort and efficiency. These handles 24 are designed to accommodate several arm lengths and to maintain the elbow in a wing configuration away from the sides of the user's body. This design effectively reduces the hazard of collision of the boney elbow with the floor or exercise surface, and allows the user to obtain a lift advantage with a partial assist from the upper torso extremity strength.

There are two projections 25 on either side of the inferior surface of the apparatus 10 (FIGS. 3–5 and 10) that serve to prevent excessive side to side rocking of the device. This effectively reduces the incidence of injury to the user's hands as they grasp through the handles 24. These "lateral stabilizers" are integrally formed in the pelvic basin portion 12.

Figure 2:
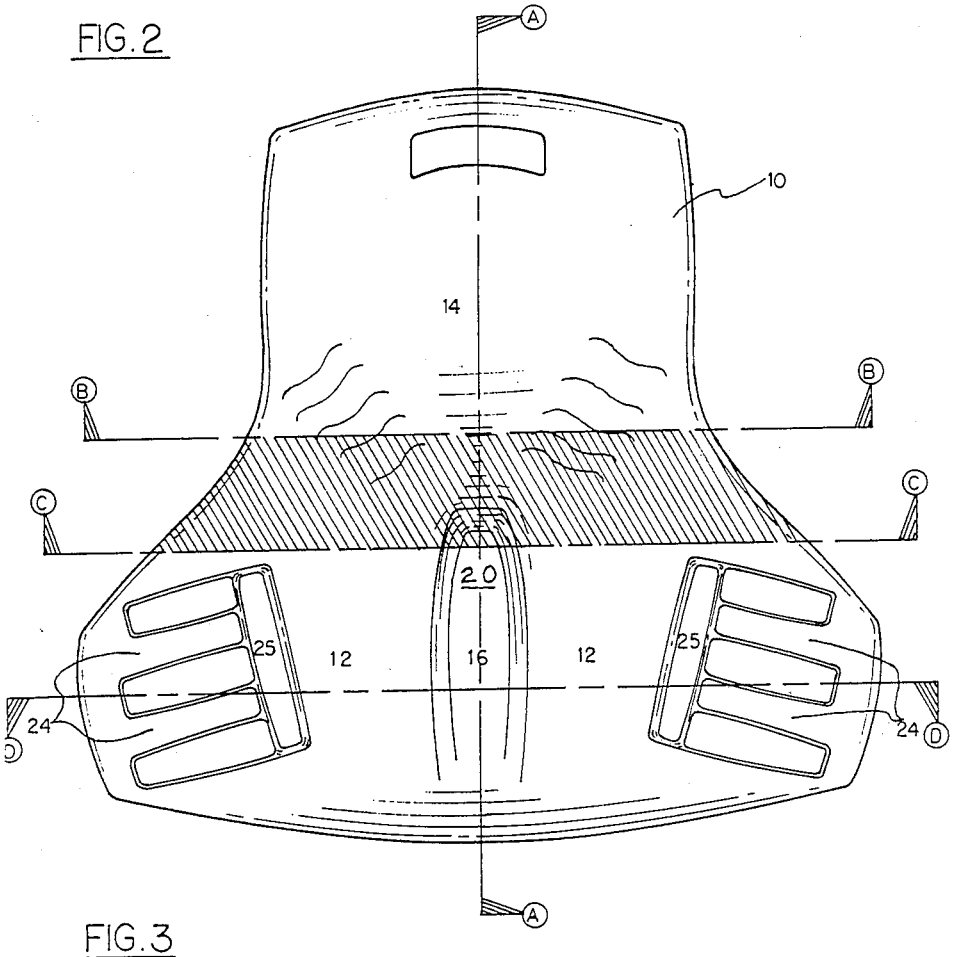
FIG. 2 is a top plan view of the apparatus.
Figure 3:
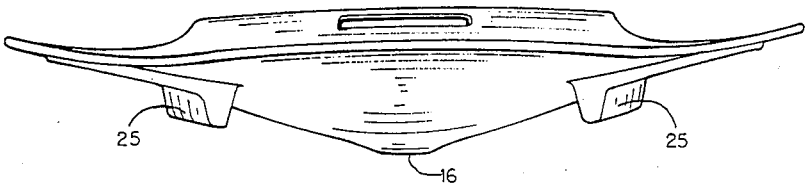
FIG. 3 is a front end elevation view thereof.

It should be noted that either or both surfaces of the apparatus 10 FIG. 2 may or may not be textured to provide a reduction in slippage between the apparatus and the user's anatomy or between the apparatus and the exercising surface, during the course of an exercise program.

OPERATION AND FUNCTION OF THE EXERCISING DEVICE

The following discussion refers particularly to FIGS. 1, 2, 9 and 10.

The user lies on his or her back (supine) with the hips and knees bent and feet flat on the floor. The exercising device 10 is then slid into place to position the basin 12 of same under the buttocks, with the lumbar spine supporting portion 14 located below the lower back. The appropriate handle length accommodating the user's arm length is grasped, with the fingers wrapping over and through the handle opening, thus allowing the user to fine tune the comfort and alignment of the apparatus 10 in relation to his or her anatomy.

The conventional sit-up exercise is commenced while still grasping the handles 24. Upper extremity arm strength may be used to partially assist the abdominals in lifting the upper torso into the sit-up exercise. It is not necessary to achieve a full sit-up position.

Figure 1:
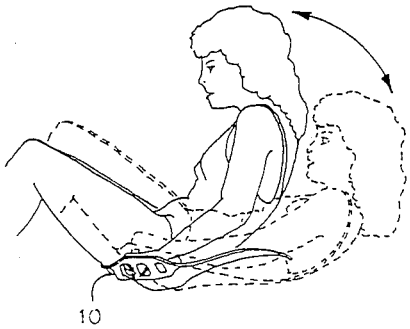
FIG. 1 illustrates use of the apparatus in a sit-up exercise.
Figure 9:
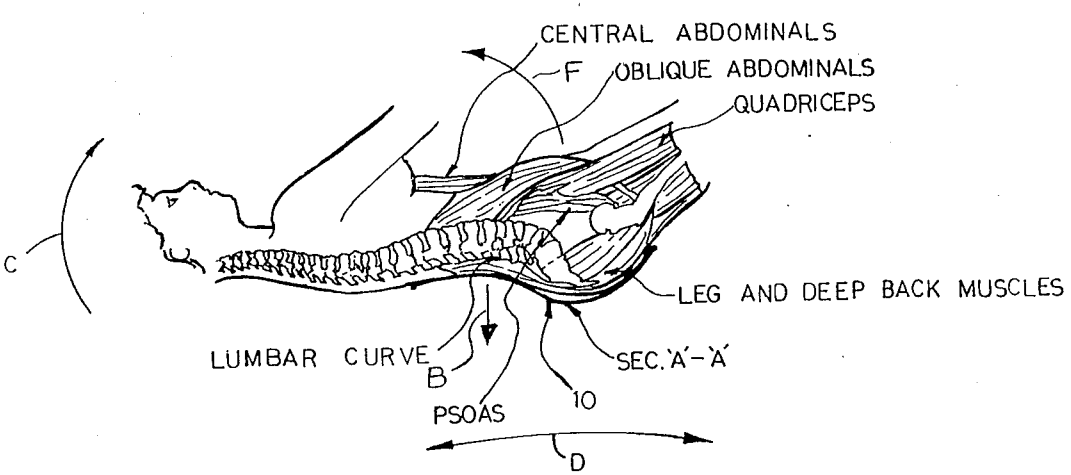
FIG. 9 is a somewhat diagrammatic side elevation, partially in section illustrating the relationship of the exercising device to the lower spine and to certain major muscle groups.

Due to the relative narrowness of the rocker portion 16 as shown in FIG. 2, the apparatus 10 will demonstrate lateral instability, rocking from side to side. The user is forced to balance upon the central rocker projection 16. This balancing is a reflex action mediated by the brain centres which activate the side muscles (internal and external oblique muscles) while performing a sit-up exercise on the apparatus. Without the apparatus 10, the conventional sit-up exercise would not effectively activate these muscles. With reference to FIGS. 1, 9 and 10, the side to side rocking of the apparatus 10 in the direction of arrow E serves to activate the oblique abdominal muscles without requiring a twisting of the lower spine. Since the boney architecture of the lower spine is not conducive to twisting movements, and since conventional sit-up exercises specifically to activate these oblique muscles require twisting of the lower spine, it is apparent that elimination of twisting activity reduces the potential for lower spine injury. An added virtue of this mechanism is a reduction in the time factor that the user must expand in the performance of sit-up exercises for the entire abdominal muscle girdle, effectively reducing the time factor by 66 percent. Conventionally, the sit-up exercise would require one sit-up straight forward and one sit-up with rotation to the left and then one sit-up with rotation to the right, to effectively exercise the abdominal muscle girdle. The apparatus of the present invention requires only one sit-up to be performed straight ahead, as opposed to three distinct sit-ups. A further added feature is the fact that since the entire abdominal muscle girdle is activated during the sit-up exercise, a greater lift potential is achieved by virtue of more muscles being involved in the exercise, and as such the exercise becomes easier to perform. This feature, combined with the greater comfort, offers the user who might otherwise not be able to perform an effective sit-up exercise positive reinforcement.

During the course of the sit-up exercise, the device 10 rocks forward, requiring more work force from the lower abdominal musculature. This forward rocking reduces the incidence of muscle substitution by the ilio-psoas muscle and the quadriceps muscle of the leg, and increases the effective range of motion through which the abdominal muscles are isolated in the exercise and are worked through a greater range of motion. FIG. 9 demonstrates the forwards and backwards rocking motions in the direction of arrow D. The pivot point of the rocker 16 is determined by the elliptical shape of the rocker portion, which is less pronounced as it tails towards the periphery of the pelvic basin portion 12 as best seen in FIGS. 4 to 8 and 10. This design effectively places the pivot point under the natural centre of gravity of the user's anatomy, thereby to provide a smooth forwards and backwards rocking motion, more effective muscle actions, and enhancing the timing of the pelvic tilt assistance as previously described. The pelvic tilt mechanism is best seen in FIG. 9 illustrated by the direction of arrow F.

With particular reference to FIGS. 5 and 6, the upwardly arched lumbar spine support portion 14 serves, as previously noted, to maintain the normal lordosis curvature. This lordosis is more commonly maintained in the standing weight bearing posture, and is inherently the strongest architecture of the lower spine. The conventional sit-up performed without the apparatus of the present invention is performed with the hips and knees bent to approximately 90 degrees, and with the lower spine flattened towards the floor by the pelvic tilt manoeuvre. This posture reduces the incidence of injury to the lower spine by virtue of a reduction in excessive lordosis or hyper-extension of the lower spine. However, with the lower spine flattened to the floor, the spine is not adequately protected. When performing a conventional sit-up without the apparatus 10, the user has a natural tendency to shorten the long "lever" defined by the upper torso. This is accomplished by arching the spine into lordosis and thereby effectively improving the leverage system and thereby the lift advantage. This may result in injury to the lower spine, especially at the lumbo-sacral transition. This factor is further complicated by the fact that in the conventional sit-up exercise the spine is moving into the direction of the pelvic structure which is relatively immobile due to the contact of the pelvis with the floor, thereby increasing the forces that potentiate injury to the lumbo-sacral transition.

When performing the sit-up exercise with the apparatus 10, referring particularly to FIG. 9 of the illustrations, it will be seen that as the subject initiates the sit-up the lumbar spine support portion flexes backwards towards the floor in the direction of arrow B thereby to reduce the incidence of exaggeration of the normal lordosis, and this helps to initiate the sit-up in the direction of arrow C. This is based on Newton's third law of physics that "for every action there is an equal reaction in opposite direction". This effectively enhances the safety of performing the sit-up exercise as the more damaging forces take place on initiation of the sit-up exercise.

As the lumbar spine support portion 14 springs backwards towards the floor in the direction of arrow B the pelvic basin portion 12 reacts by springing forwards in the direction of arrow F producing the pelvic tilt manoeuvre as previously referred to.

The flexible transition area shaded between lines B—B and C—C on FIG. 2 interfaces the lumbar spine support portion 14 and the pelvic portion 12, and ensures the maintenance of the normal lumbo-sacral angle thereby to reduce stress and prevent injury to the lumbo-sacral anatomy.

The timing of these actions is determined by the placement of the pivot point in the rocker portion 16 and thus the elliptical design of the rocker portion as previously referred to.

After initiation phase of the sit-up exercise with the apparatus 10 is completed, the user activates the entire abdominal muscle girdle as he or she balances and lifts into the resistance determined by the inclination of the rocker portion 16. As the resistance of the rocker portion is overcome at the pivot point, the apparatus 10 rocks forwards carrying the user's pelvis in the direction of arrow D. Due to this rocking mechanism, the abdominal musculature attachments to the rib-cage and to the pelvis are passively moving away from each other thereby creating a greater demand on the muscles through a longer range of motion. At the same time, the muscles that may normally substitute for the abdominal muscles, namely the ilio-psoas and the quadriceps femoris, exhibit their attachments to passively move into approximation, thus rendering these muscles ineffective in the aid of lifting to perform the sit-up exercise.

The apparatus 10 serves to support the user's anatomy in a position of comfort, while elevating the body to allow the exercise device to interface between the body and the floor or exercise surface.

Referring to FIGS. 2 and 10, the handles 24 are designed to accommodate several arm lengths. The user grips the handles from above by sliding the fingers through one of the openings to grasp the under surface, and rests the thumb in the depression formed on the upper surface by the lateral stabilizers 25. This design effectively reduces the incidence of injury to the user's hands while performing the exercise routine, and maintains the elbows in a wing configuration away from the sides of the body so as to avoid collision of the boney elbow with the floor. The handles 24 serve to act as partial assist in lifting the upper torso into the sit-up range of motion with the use of upper extremity strength, and to assist the user in maintaining position and comfort on the apparatus 10. A further feature of the partial assist with the upper extremity strength is that this allows the weaker individual to perform the exercise and thereby receive positive reinforcement, while it allows the stronger individual to perform the exercise repetitions beyond normal fatigue of the abdominal muscles, and thereby to maximize the progression of muscle strength and endurance.

The exercise program may initially be commenced on a soft surface, such as a bed or exercise mat, as this reduces the rocking motions and thereby the lift demands on the abdominal musculature. Progression of the level of difficulty may be undertaken by performing the exercise on an increasingly more firm surface.

The grasping of the handles in performing the exercise with the apparatus is not absolutely essential as relative hand position is not critical to the performance of the apparatus.

Though the apparatus does effectively reduce the incidence of stress to the user's anatomy, should the exercise be painful or physiologically harmful the exercise should be immediately discontinued and consultation with a physician undertaken.

While most of the above discussion has been directed to the performance of the usual or conventional sit-up exercise, it will be clear that the exercising device of the present invention may be used for a number of other exercises so as to protect or maintain the user's spine in a comfortable manner and so as to enhance the purpose of some exercises. Particularly, floor or mat exercises that involve the lower torso including the legs, such as leg raised or supine bicycling, may be effectively performed using the apparatus of the present invention.

A further or additional component may be included with or separately purchased for use with the exercise device of the present invention, as is particularly shown by the dashed lines in FIGS. 5 and 8. There, an add-on shoe or additional wedge structure 30 is shown, which fits generally beneath the rocker portion 16 and increases the inclination of the contacting surface of the rocker portions 16 with the supporting surface (floor or mat) on which the exercise is to be performed. The purpose is particularly to increase the inclination of the rocker portion 16, and thereby the resistance to rocking, and also to increase the extent of lateral tipping of the device. This increases the degree of difficulty of the sit-up exercise for an expert. Indeed, as the user becomes more expert, different add-on shoes 30 can be provided, possibly colour coded to indicate the degree of expertise required or to be attained. Alternatively, the lower surface of the add-on shoe 30 may be movable or tiltable—as by the operation of an hydraulic cylinder—particularly for installations of the exercise device in such circumstances where it may be constantly and continually in use as in a physical fitness gymnasium or the like.

It will be seen from the above that the exercising apparatus described herein is very simple to use in an effective manner, and that it has many built-in safeguards which assist in protecting the user against the potential hazards encountered in the conventional sit-up exercise. The inherent simplicity of the apparatus means that it can be produced in quantity at relatively low consumer cost.

I claim:

1. Apparatus for use in exercising the abdominal muscles, comprising:

a pelvic basin portion for receiving the buttocks and supporting the pelvis, and having a longitudinal axis of symmetry;

a lumbar spine support portion having a transition portion extending rearwardly from the pelvic basin portion, and arching upwardly to support the anatomical transition between the sacrum and the lumbar spine at an anatomically acceptable lumbo-sacral angle, said lumbar spine support portion being aligned with the axis of symmetry; and a rocker portion extending below said pelvic basin portion, so that in use said apparatus will rock front to back as a whole about an axis transverse to the symmetry axis;

and wherein:

said lumbar spine support portion is smoothly convexly arched upwardly such that, when in use with the user's buttocks positioned in the pelvic basin portion the user's lower back and lumbo-sacral angle is disposed on said lumbar spine support portion and said transition portion, and is anatomically acceptably supported; and said lumbar spine support portion is further shallowly concavely curved around the axis of symmetry, whereby to deliver lateral support to the lower spine when placed therein during use.

2. Apparatus according to claim 1 wherein said rocker portion has a substantially elliptical shape which defines a pivot point that facilitates the ease of forward rocking so as to demand more isolated abdominal muscle activity by the user through a greater range of motion.

3. Apparatus according to claim 2, wherein said rocker portion is aligned with the symmetry axis, and is curved at its bottom so as to cause side to side rocking of the exercising apparatus whereby to reflexly activate the oblique abdominal muscles of the user during use.

4. Apparatus according to claim 2, wherein said pelvic basin portion includes a pair of buttock receiving and supporting areas on opposite sides of the symmetry axis, and a recess aligned with said axis of symmetry that gradually flares outwards and upwards in the configuration of a triangle and which resembles the anatomical shape of the pelvic sacrum bone, where said recess extends into the transition area between the pelvic basin and lumbar spine support portions.

5. Apparatus according to claim 2 wherein said rocker portion is integrally formed in said pelvic basin portion as an elliptically contoured projection; and said recess is defined in the upper face of the pelvic basin portion, being deeper at its origin and becoming shallower as it extends towards the periphery of said pelvic basin portion.

6. Apparatus according to claim 3, where said pelvic basin portion has a pair of downwardly directed projections, one at each side thereof, whereby so as to limit the extent of lateral rocking of said apparatus.

7. Apparatus according to claim 6, where a pair of handle portions are formed, one at the outer side of each of said projections; where said handle portions each comprise at least one aperture formed through the thickness of the material of said apparatus.

8. Apparatus according to claim 7, wherein said pelvic basin portion, lumbar spine supporting portion, rocker portion, downwardly directed projections and handle portions comprise integral parts of a unitary body.

9. Apparatus according to claim 8, where said apparatus is in the form of a unitary body made from a relatively thin moulded shell of injected, extruded or vacuum formed plastic material.

10. The apparatus according to claim 9, wherein the transition area between said pelvic basin portion and said lumbar spine supporting portion is more flexible than its adjacent portions, and said rocker portion is less flexible than its adjacent portions.

11. Apparatus according to claim 10, wherein said apparatus has a textured surface to reduce potential slippage between the apparatus and the user's anatomy during use.

12. Apparatus according to claim 7, where each said handle portion has a plurality of grasp handles that accommodate several arm lengths; where said handles maintain the user's upper extremity in a wing configuration with the user's arms away from the sides of the body, and thereby prevent injury to the user's elbows by collision with the exercise surface on which said apparatus has been placed.

13. Apparatus according to claim 1, including a further add-on structure which fits below and mates to the rocker portion so as to present a differing angle of inclination of the rocker portion to a surface on which said apparatus is placed.

* * * * *